United States Patent [19]

Heller

[11] 4,430,987

[45] Feb. 14, 1984

[54] INFRARED HEATING SYSTEM AND APPARATUS

[76] Inventor: Anton H. Heller, 78 Wantagh Ave., Levittown, N.Y. 11756

[21] Appl. No.: 215,091

[22] Filed: Dec. 10, 1980

[51] Int. Cl.[3] ..... F23L 11/00

[52] U.S. Cl. ..... 126/141; 126/121; 126/39 D; 126/92 AC

[58] Field of Search ..... 237/51; 126/121, 122, 126/132, 129, 131, 141, 39 D, 92 AC

[56] References Cited

U.S. PATENT DOCUMENTS

| | | | |
|---|---|---|---|
| 1,703,459 | 2/1929 | Sala | 126/121 |
| 2,060,079 | 11/1936 | Hood | 126/121 |
| 3,896,785 | 7/1975 | Nelson | 126/121 |
| 3,952,722 | 4/1976 | Yamagishi | 126/141 |
| 4,194,490 | 3/1980 | Crnkovic | 126/141 |

FOREIGN PATENT DOCUMENTS

| | | | |
|---|---|---|---|
| 717942 | 11/1954 | United Kingdom | 126/141 |

*Primary Examiner*—Albert J. Makay
*Assistant Examiner*—Henry Bennett
*Attorney, Agent, or Firm*—Cooper, Dunham, Clark, Griffin & Moran

[57] ABSTRACT

System and apparatus for concentrating and directing heat energy for use, by way of example, in home fireplaces. The apparatus includes at least one infrared absorber-emitter arranged so as to prevent flame from a burning log from entering into an interior space being heated, to direct smoke from the log into a chimney and to direct infrared radiation into the space being heated. The infrared absorber-emitter preferably is a high nickel-chromium-iron alloy.

6 Claims, 3 Drawing Figures

INFRARED HEATING SYSTEM AND APPARATUS

BACKGROUND OF THE INVENTION

The present invention relates to a system and apparatus for concentrating and directing heat energy. More particularly, the invention relates to a system and apparatus for heating interior space by absorbing heat energy produced by a heat source in a fireplace and emitting infrared radiation into the interior space.

It has long been known that in burning wood in a fireplace to heat space, it is desirable to direct as much as possible of the heat energy into the room to be heated, rather than upwardly and outwardly through the chimney into the atmosphere. Of course, the more heat energy that is directed into the room, the more the room is heated and, conversely, the more heat that is directed up the chimney, the less the room is heated. Various schemes have been tried over the years to direct more of the heat energy into the room. Some examples are use of reflectors for radiating heat into the room; use of glass doors to radiate heat; building a heat exchanger into the fireplace rear and side walls for transferring heat into the room; and special configurations of the fireplace walls. Nevertheless, prior systems direct only about 20% of the heat energy produced by burning wood in a fireplace into a room. The remainder of the heat goes up the chimney and is wasted.

It has been a particularly vexing problem to design a system capable of directing a greater percentage of the heat energy into an interior space. To build a larger fire in the fireplace is wasteful because it consumes an excessive amount of wood. Although burning more wood will produce more heat, this does not necessarily mean that more heat is directed into the room. The same percentage of heat may be wasted up the chimney because the flue must remain open in order to permit the combustion products to exit the fireplace and not inadvertently pass into the room being heated. There has been no prior effective system for directing a substantial percentage of the heat energy created by burning wood in a fireplace into the room, rather than wasting the heat by permitting it to go up the chimney.

SUMMARY OF THE INVENTION

It is a primary object of this invention to provide a system for concentrating and directing heat energy.

It is another object of the invention to provide apparatus for use in a fireplace to direct a substantial portion of the heat energy into an interior space to be heated.

It is a further object of the invention to provide an infrared heating apparatus for home use.

It is well known that solid materials emit radiation as they are heated. As the temperature of the material is increased, radiation becomes visible as a dark red glow. As the temperature of an iron bar, for example, is raised to about 1000° F., the red glow becomes barely visible. Infrared radiation is energy in the invisible range beyond the red end of the spectrum. This radiation may be transferred in the form of heat without any conducting substance. The present invention utilizes this principle by providing a system for concentrating and directing heat energy for use in a home fireplace, by way of example.

The system of the present invention concentrates and directs heat energy produced by a heat source which also produces a flame and smoke and other combustion products. The heat energy created is absorbed by at least one infrared absorber-emitter which is arranged on a frame above the heat source. The infrared absorber-emitter is heated to a temperature of about 1200 to 1400° F. and emits infrared radiation. The infrared absorber-emitter is adjustable in position to prevent the flame from entering the interior space being heated while directing the smoke into the chimney. It is also adjustable to direct a substantial percentage of the infrared radiation properly into the interior space. The infrared absorber-emitter preferably is a perforated sheet of a high nickel-chromium-iron alloy, for example, an alloy sold under the name "Inconel." Preferably, a plurality of infrared absorber-emitters is employed to properly concentrate and direct the heat energy.

DETAILED DESCRIPTION

Generally, the system of the present invention concentrates and directs heat energy by employing specially arranged infrared absorber-emitters positioned above a heat source, such as a burning log. The absorber-emitters are arranged such that flame from the burning log is prevented from entering the space to be heated, while combustion products such as smoke and finely divided particles are directed up the chimney. However, the infrared radiation is properly directed into the interior space to be heated.

Figure 1:
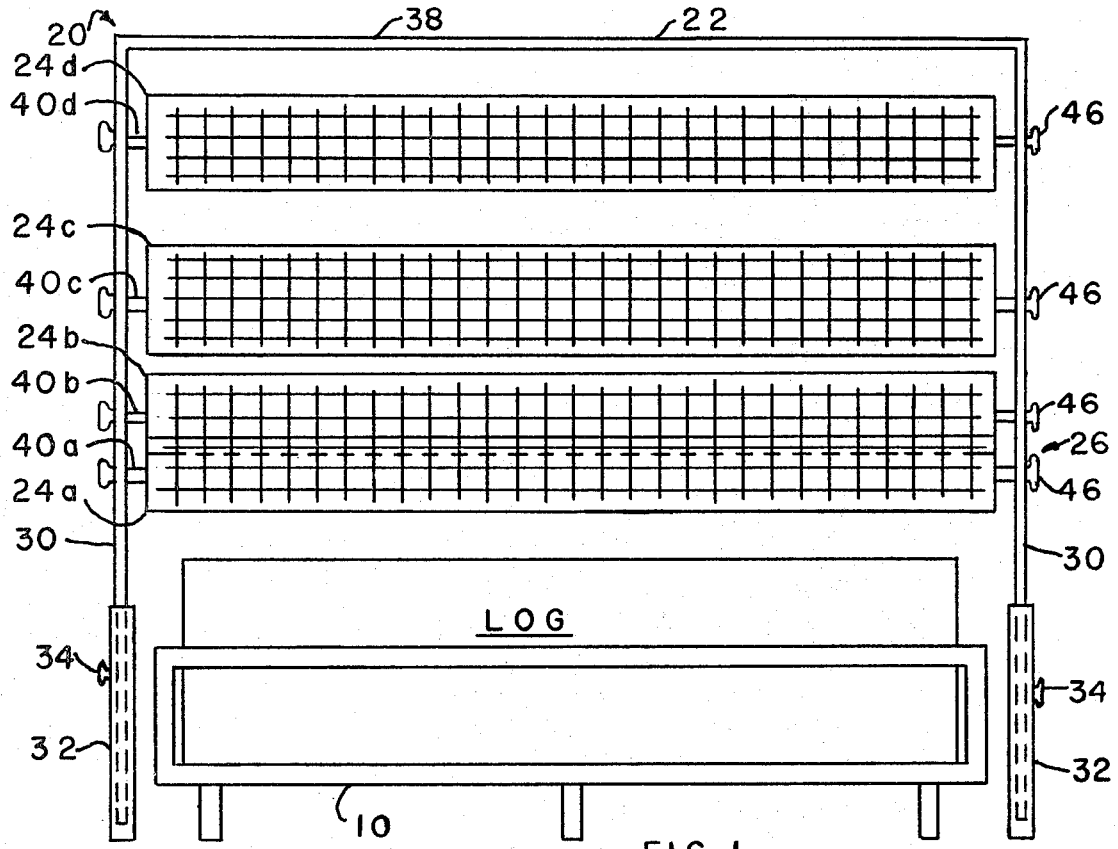
FIG. 1 is a front elevational view of infrared heating apparatus for use in a system in accordance with the invention.
Figure 2:
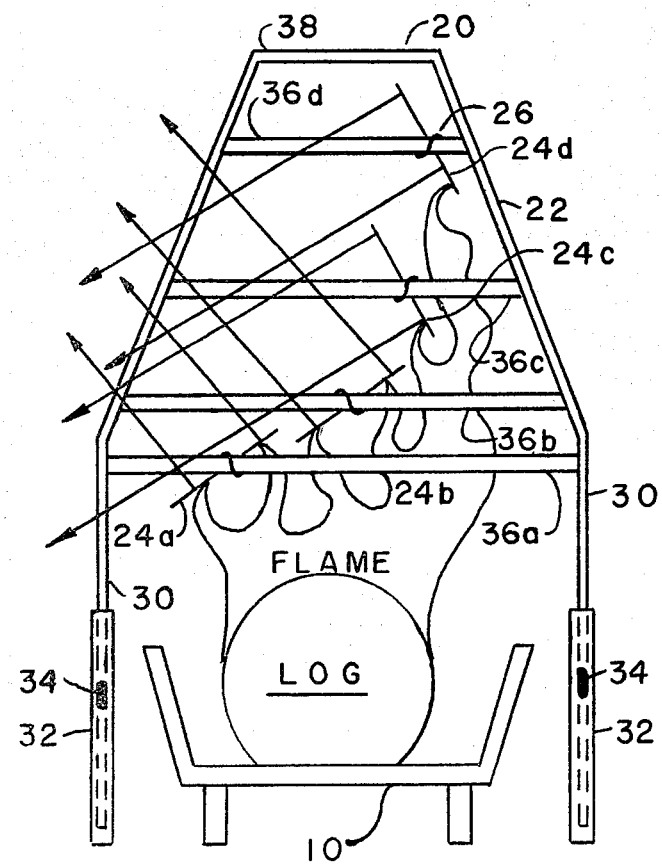
FIG. 2 is a side elevational view of the apparatus shown in FIG. 1.

Referring to FIGS. 1 and 2 of the drawings, a log is positioned within a conventional grate 10 for use in a conventional home fireplace (not shown). Although any log or logs are suitable as a heat source for use in the system of the invention, it is desirable to use an artificial log, as for example, a log made of charcoal and wax sold under the name "Duraflame." Artificial logs are of constant size and their use avoids the necessity for adjustment of the apparatus as will hereinafter be described. It is also desirable that a log of about 6 inches in diameter and slightly less than 24 inches in length be used in practising the invention. Using a larger log or a greater number of logs may produce too much heat and make the space being heated uncomfortable. On the other hand, using a smaller log may not produce enough heat to be effective.

Apparatus 20 is used for concentrating and directing heat energy in accordance with the system of the invention. Apparatus 20 generally comprises a frame 22; at least one infrared absorber-emitter 24; and adjusting means 26.

The frame 22 is rigid, but lightweight, and is fabricated from a suitable material, for example, hot rolled steel. It should be of a size suitable to fit into a conventional home fireplace. For example, the frame may be approximately 30 to 36 inches wide, 24 to 30 inches high and 18 to 24 inches deep, although other sizes also may be appropriate. Frame 22 includes four legs 30 which converge toward the top. Each pair of legs 30 defines a side of the frame 22.

Preferably, each of the legs 30 is provided with means for adjusting its length so that the frame 22 may be positioned at a suitable vertical distance from the log. To this end, feet 32 are positioned on the legs 30 in telescoping engagement and are connected to the legs by suitable fasteners 34, for example, a threaded shank with a wing nut or a set screw, which extends through an opening in the foot 32 and engages the leg 30. By adjusting the position of the feet 32 relative to the legs 30, the height of the frame 22 relative to the heat source may be adjusted. Other suitable height adjustment means may also be used.

As best shown in FIG. 2, connecting the pair of legs 30 at each side of the frame 22 are a plurality of braces 36. The braces 36 are fastened between the pair of legs 30 to form rigid sides of the frame 22. Preferably, four braces 36 are used to define a side. A pair of rods 38 connect the two sides of the frame 22 at the top, as best seen in FIG. 1.

A plurality of shafts 40 are arranged parallel to the rods 38 and interconnect the braces 36 on the opposite sides of the frame 22. Thus, the two lowermost braces 36*a* on each side of the frame 22 are connected by the lowermost shaft 40*a;* the two uppermost braces 36*d* on each side are connected by the uppermost shaft 40*d;* and so on. The rods 38 and the shafts 40 connect the sides of the frame 22 so as to complete the rigid stucture. Alternatively, the sides, braces and rods may be articulated so as to permit folding, shipping and storing the frame.

Figure 3:
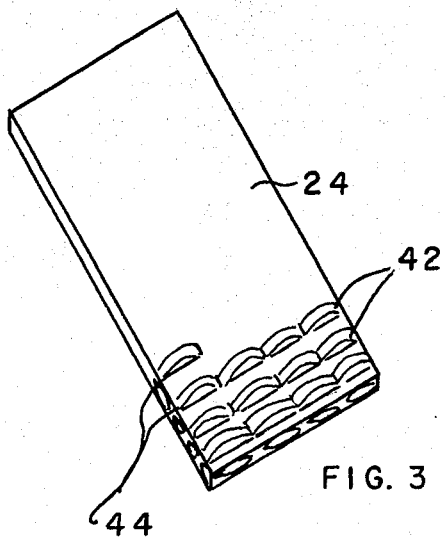
FIG. 3 is a perspective view of an infrared absorber-emitter used in the system and apparatus of the invention.

At least one infrared absorber-emitter 24 is positioned on the frame 22. The infrared absorber-emitter absorbs heat energy produced by the burning log or other heat source and emits infrared radiation. The infrared absorber-emitter is rectangular in shape, and for use in a home fireplace, is for example, about 24 inches long and about 3 to 4 inches wide, as best shown in FIG. 3. Preferably, the infrared absorber-emitter 24 is fabricated from a high nickel-chromium-iron alloy, for example, an alloy sold under the name "Inconel." That alloy has the ability to be repeatedly heated and cooled and is readily available in cold-rolled sheet form. It has good corrosion resistance, good hot and cold workability and good high-temperature properties. That alloy contains about 75 to 80% nickel, about 13% chromium, about 6% iron, and small amounts of other elements. However, it should be appreciated that any other suitable material which has the same properties may be employed. A mild steel could be used, for example, but would probably be consumed in a short period of time.

Desirably, in the system of the present invention, four infrared absorber-emitters 24 are used. Each is mounted upon an axially extending shaft 40 arranged horizontally within the frame 22. The four infrared absorber-emitters 24 desirably are arranged in pairs. The two lowermost absorber-emitters 24*a* and 24*b* are mounted on the two lowermost shafts 40*a* and 40*b*, respectively. The shafts 40*a* and 40*b* and the absorber-emitters 24*a* and 24*b* are positioned in parallel and about 3 inches apart in the vertical direction. As shown, the lowermost absorber-emitter 24*a* is arranged so that it extends outwardly a few inches, for example 3 inches, beyond the log toward the space being heated, that is, toward the front of the fireplace. In combination, the two lowermost absorber-emitters 24*a* and 24*b* prevent flame rising from the burning log from penetrating into the space being heated. As best shown in FIG. 2, they act in combination to direct the heat energy substantially toward the front of the fireplace and the upper part of the space being heated (as shown by the arrows).

Similarly, the uppermost pair of absorber-emitters 24*c* and 24*d* are mounted respectively on the uppermost shafts 40*c* and 40*d*. These shafts and absorber-emitters are positioned in parallel and are about 6 inches vertical distance apart. Shaft 40*c* is positioned about 6 inches apart from shaft 40*b*. As shown, the uppermost absorber-emitter 24*d* is positioned so that it extends outwardly a few inches beyond the heat source toward the back of the fireplace and away from the space being heated. The four absorber-emitters 24*a*–24*d* thus are positioned from the front toward the back of the fireplace and the frame as they are positioned vertically upwardly from the log toward the top of the fireplace. However, they may be arranged in a different array than that shown by way of example in FIG. 2.

The uppermost pair of absorber-emitters 24*c* and 24*d* is arranged at substantially a right angle to the lowermost pair of absorber-emitters 24*a* and 24*b*. As the uppermost pair is positioned a substantial distance above the burning log, at least one foot, it is not necessary that the pair be positioned so as to prevent the flame from entering the room. By positioning the uppermost pair at a different angle to the frame than the lowermost pair, the uppermost pair act in combination to concentrate and direct the heat energy substantially toward the front of the fireplace and the lower part of the space being heated (as shown by the arrows in FIG. 2). By positioning the uppermost absorber-emitters 24*c* and 24*d* at substantially a right angle to the lowermost absorber-emitters 24*a* and 24*b*, a pair of channels is provided for the smoke and other combustion products from the burning log to exit between the absorber-emitters and pass outwardly from the fireplace through the chimney flue into the atmosphere. Thus, the four absorber-emitters 24 acting in combination direct a high percentage of the heat energy, but not the flame and smoke, outwardly into all areas of the room. If the fireplace is exceptionally large or small, a greater or lesser number of infrared absorber-emitters or larger or smaller such devices may be used in an array.

In addition, the absorber-emitters 24 direct a portion of the heat energy inwardly and toward the back of the fireplace. If there is a heat exchanger within the fireplace wall, the air therein will be heated and additional heat will be directed into the room.

The absorber-emitter 24 may, but need not be, cold-rolled flat sheets of alloy. Preferably, the alloy sheet is perforated. However, material is not removed during fabrication, but is pressed outwardly from the plane of the sheet to form a plurality of lands 22 and a corresponding plurality of openings 44. The openings 44 permit passage of air through the absorber-emitters 24 for better transmission of the infrared radiation. Although such perforated sheets have been used elsewhere in transmitting infrared radiation, they are not known for use in the system of this invention.

The burning log generates a flame which through both conduction and convection heats the infrared absorber-emitters 24 to a high temperature. The lowermost absorber-emitter 24*a*, which is closest to the flame, is heated at a temperature of about 1200° to 1400° F. Thus, a substantial amount of heat is radiated outwardly by the absorber-emitters 24 into the space being heated. If the absorber-emitters 24 are heated to a higher temperature, for example by using more logs, then the infrared radiation produced by the apparatus 20 may make persons in a small room or too close to the fire uncomfortable. Indeed, infrared radiation increases geometrically by a power of four, such that if the temperature is doubled, the radiation increases 16 times.

Adjusting means 26 are provided for properly directing the infrared radiation into the space being heated and for preventing the room from becoming too hot. Adjusting means 26 permit the infrared absorber-emitters 24 to be positioned at proper angles to direct infrared radiation outwardly into the space being heated while causing smoke and other combustion products to pass upwardly through the flue, and the flame to be maintained within the fireplace. Although adjusting means 26 may be any suitable device, desirably each comprises the threaded end of the respective shaft 40*a* through 40*d* and a wing nut 46 securing the end of the shaft to the respective brace 36*a* through 36*d*. Under some circumstances, it is contemplated making adjusting means 26 difficult to use so that a user cannot adjust the apparatus 20 in an incorrect manner.

The detailed description is intended to be illustrative of apparatus 20 for use in the system of the invention. Apparatus 20 is believed capable of concentrating and directing up to 50% of the heat energy produced by a fire into a space to be heated. Nevertheless, it should be appreciated that various modifications could be made in apparatus 20 which still come within the scope of the invention. Many other uses of apparatus 20 will be apparent to those working in this field.

I claim:

1. A system for concentrating and directing heat energy into a space to be heated comprising:

(a) a source of heat energy which produces a flame and combustion products;

(b) an array of elongated, substantially planar means for absorbing heat energy from said source, wherein the means is heated to a temperature in excess of about 1200° F. for emitting infrared radiation, at least one of the means having a transverse axis positioned at an angle of about 45° to the transverse axis of another of the means;

(c) means for arranging the array of absorbing and emitting means to direct said infrared radiation both upwardly and downwardly into the space to be heated; and (d) means for positioning the array of absorbing and emitting means for preventing the flame from entering the space and for channeling the combustion products into the external atmosphere at a location remote from the space;

(e) wherein said absorbing and emitting means comprises a perforated sheet of a high temperature alloy adapted to permit the passage of combustion products therethrough.

2. A system according to claim 1, wherein said absorbing and emitting means is heated to a temperature of about 1200°–1400° F. by said source of heat energy to thereby emit infrared radiation.

3. A system according to claim 1, wherein at least one of the array of absorbing an emitting means extends outwardly beyond the heat source toward the space being heated.

4. A system according to claim 1, wherein at least one of the array of absorbing and emitting means extends outwardly beyond the heat source away from the space being heated.

5. Infrared heating apparatus for fireplaces, comprising:

(a) a frame positionable above a heat source;

(b) at least two positionable, elongated, substantially planar, perforated, infrared absorber-emitters connected to said frame, said infrared absorber-emitters being adapted to receive heat energy from the heat source, wherein the absorber-emitters are heated to a temperature in excess of about 1200° F. to emit infrared radiation; and (c) adjusting means connecting said infrared absorber-emitters to said frame, whereby said infrared absorber-emitters may be arranged such that their transverse axes are at substantially right angles to each other (i) to prevent flame from the heat source from entering into an interior space being heated, (ii) to direct smoke from the heat source into a chimney for discharge into the atmosphere, and (iii) to direct infrared radiation both upwardly and downwardly into the interior space being heated.

6. Infrared heating apparatus according to claim 5, wherein said infrared absorber-emitters are fabricated from a high nickel-chromium-iron alloy.

* * * * *